US007055736B1

(12) United States Patent
Lackey et al.

(10) Patent No.: US 7,055,736 B1
(45) Date of Patent: Jun. 6, 2006

(54) MAILBOX WITH SIGNAL

(75) Inventors: Robert W. Lackey, Hickory, NC (US); Robert C. Beckmann, Vail, NC (US)

(73) Assignee: RWL Corporation, Hickory, NC (US)

( * ) Notice: Subject to any disclaimer, the term of this patent is extended or adjusted under 35 U.S.C. 154(b) by 0 days.

(21) Appl. No.: 11/047,977

(22) Filed: Feb. 1, 2005

(51) Int. Cl.
*A47G 29/12* (2006.01)

(52) U.S. Cl. ..... 232/34; 232/17

(58) Field of Classification Search ..... 232/34, 232/35, 17, 45, 38; D99/29–32
See application file for complete search history.

(56) References Cited

U.S. PATENT DOCUMENTS 2,514,313 A * 7/1950 Davidson et al. ..... 248/183.2
2,551,915 A * 5/1951 Turner ..... 232/34
4,813,595 A * 3/1989 Johns et al. ..... 232/17
5,082,170 A * 1/1992 Goss ..... 232/35
5,119,986 A * 6/1992 Kobilarcik et al. ..... 232/35
5,664,729 A * 9/1997 Ladewig ..... 232/39
D385,680 S * 10/1997 Cacciola et al. ..... D99/29
D488,908 S * 4/2004 Hradisky ..... D99/29
D489,159 S * 4/2004 Hradisky ..... D99/29
D489,160 S * 4/2004 Hradisky ..... D99/29
6,729,535 B1 * 5/2004 Lackey et al. ..... 232/17
D497,465 S * 10/2004 Hradisky ..... D99/29

* cited by examiner

*Primary Examiner*—William L. Miller
(74) *Attorney, Agent, or Firm*—Charles L. Schwab; Nexsen Pruet, LLC

(57) ABSTRACT

A signal is provided for a plastic mailbox which is pivotally secured to one of its side wall structures for raising from a lowered position to a releasably detented raised position. A frusto-conical shaft on the lower end of the signal engages a conical bore in a connected between laterally spaced inner and outer walls. A depression or pocket is provided on the inside of the side wall structure at the signal pivot for receiving a head of a fastener and a releasable detent is provided for releasably maintaining the signal in its raised position.

8 Claims, 3 Drawing Sheets

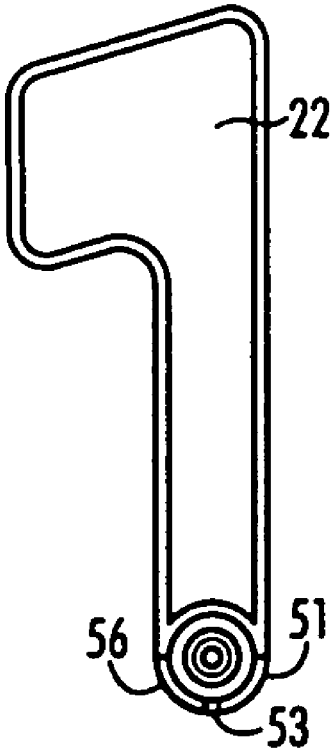
FIG. 6
FIG. 7
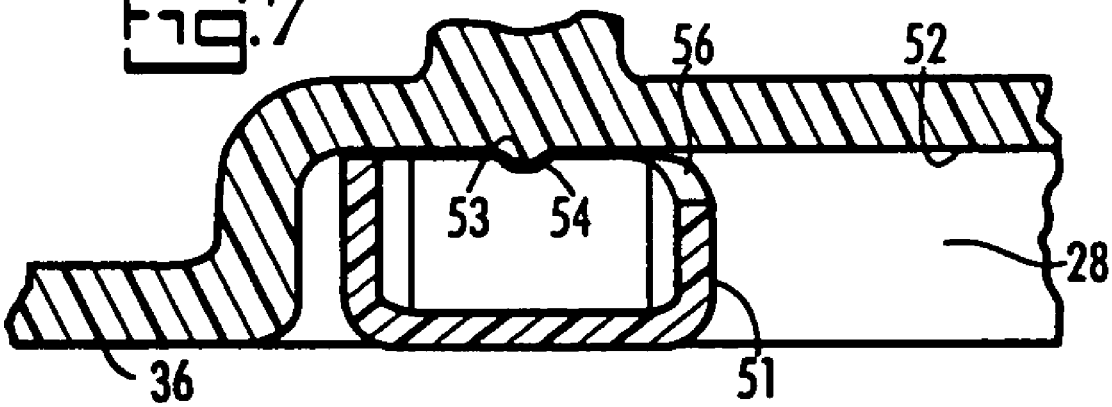

MAILBOX WITH SIGNAL

BACKGROUND OF THE INVENTION

Roadside mailboxes are equipped with a signal device that can be raised to tell the mail carrier that one or more letters have been placed in the mailbox for pick up. A commonly used signal has the shape of a flag on a pole, which is pivotally attached to one lateral side of the mailbox on a laterally extending horizontal axis for manual movement between a raised and lowered position.

BRIEF SUMMARY OF THE INVENTION

A plastic mailbox has a side wall structure including inner and outer walls with an integrally formed rigid connector therebetween in which a laterally extending conically shaped opening is formed for receiving a frusto conical pivot shaft on the lower end of a signal. The inner wall of the side wall structure has a pocket for receiving a washer and a head of a retaining screw engaging a bore coaxially formed in the pivot shaft. The signal is manually pivotable about the axis of the conically shaped opening in the sidewall structure between a lowered position and a releasably detented raised position.

BRIEF DESCRIPTION OF THE DRAWINGS

The mailbox and signal are illustrated in the accompanying drawings, in which:

FIG. 6 is a view taken on line 6—6 in FIG. 4; and

FIG. 7 is a partial section taken on the line 7—7 in FIG. 2.

DETAILED DESCRIPTION OF THE INVENTION

Figure 1:
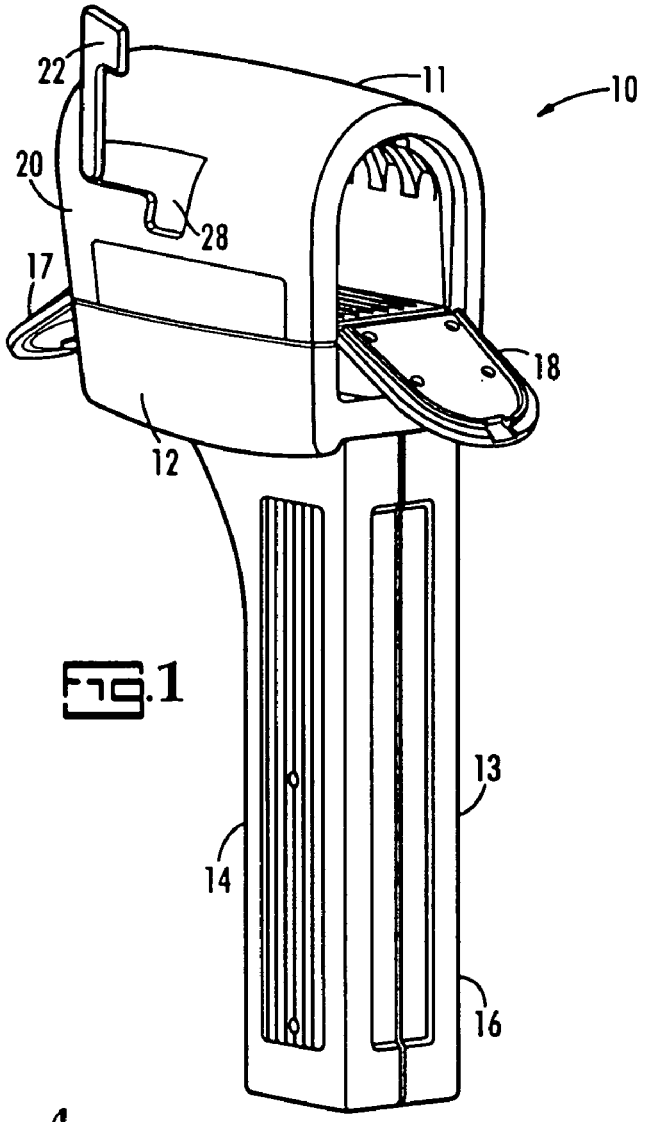
FIG. 1 is a perspective view of a mailbox with a raised signal.
Figure 2:
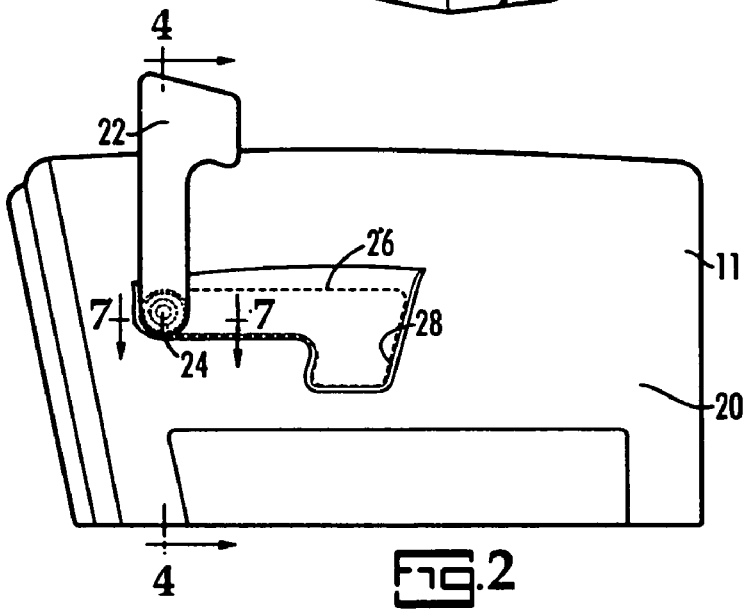
FIG. 2 is a side view of the postal box portion of the mailbox.
Figure 3:
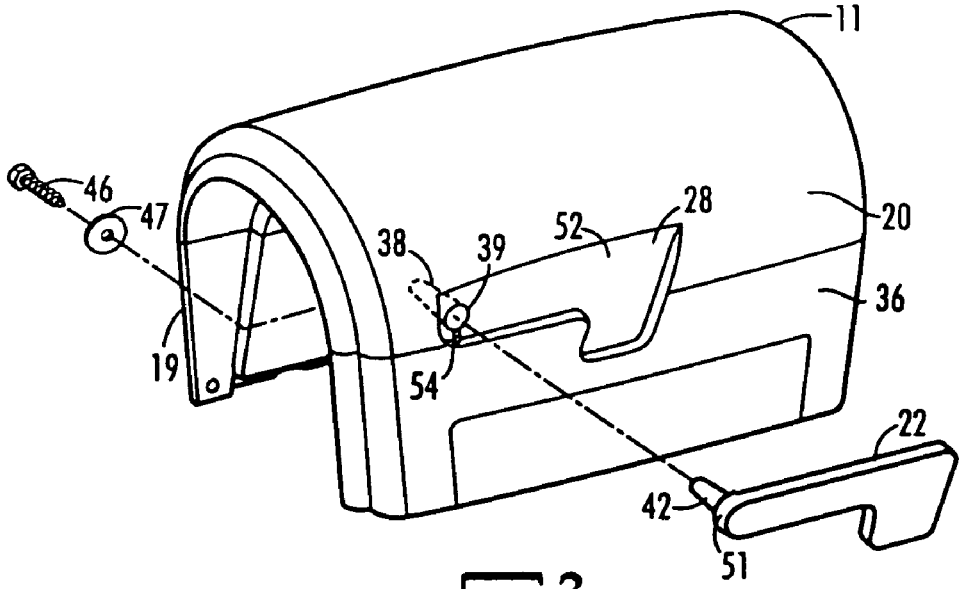
FIG. 3 is an exploded perspective view of the postal box portion of the mailbox showing the flag and its fastening components.

As shown in FIGS. 1, 2 and 3, a plastic mailbox 10 includes a postal box 11, a newspaper box 12 and a support column 13 formed of two side by side sections 14, 16 which are attached at their upper ends to the underside of the newspaper box 12. A front door 17 and a rear door 18 are pivotally connected at their lower ends to the lower ends of the laterally spaced side wall structures 19, 20 of the postal box 11. A signal 22 is pivotally connected to side wall structure 20 for manual swinging movement about a laterally extending horizontal axis 24 between a lowered horizontal position shown by broken lines 26 in FIG. 2 and a raised vertical signaling position shown in FIGS. 1, 2 and 4. In its lowered position, the signal 22 is recessed in a depression or indentation 28 in the laterally outer wall 36 of the side wall structure 20.

Figure 4:
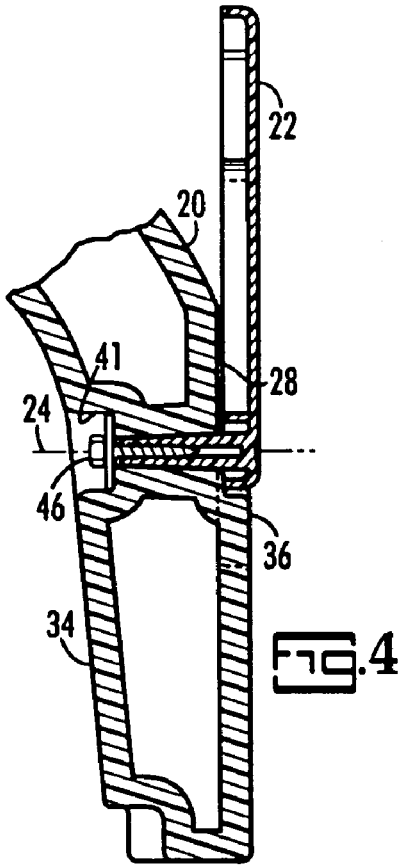
FIG. 4 is a partial section taken on the line 4—4 in FIG. 2.
Figure 5:
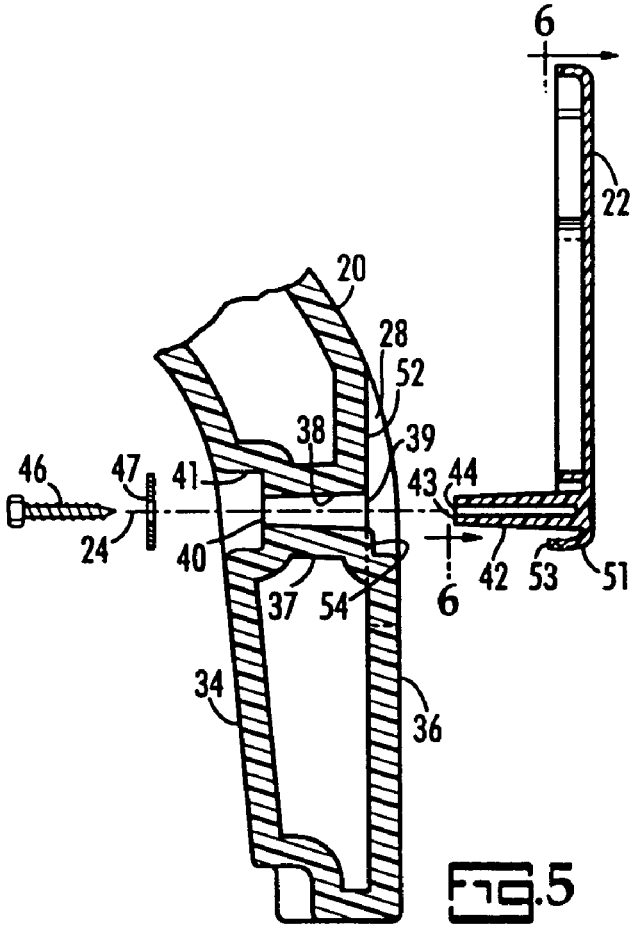
FIG. 5 is a view similar to FIG. 4 but showing the flag and its fastening components in exploded positions.

Referring also to FIGS. 4, 5 and 6, the side wall structure 20 includes a laterally inner wall 34 and an outer wall 36 spaced laterally outward from the inner wall 34. A laterally extending connector 37 is integrally formed between the walls 34, 36 and a conically shaped laterally extending horizontal hole or bore 38 is formed in the connector 37. The laterally outer end of the conically shaped bore 38 terminates in an opening 39 in the indentation 28 of the outer wall 36 and the laterally inner end of the bore 38 terminates in an annular opening 40 in an annular depression 41 in the inner wall 34. A frusto conical shaft 42 is integrally formed on the lower end of the signal 22 and extending in cantilever fashion therefrom in a horizontal direction. The shaft 42 tapers to a reduced diameter at its distal end 43 in which a screw receiving hole or bore 44 is drilled in coaxial relation to the conically shaped shaft 42. The signal 22 is installed by placing the conically shaped shaft 42 in the conically shaped bore 38, passing a fastener in the form of a screw 46 through a washer 47 and threading the screw 46 into the coaxially formed bore 44 in the conically shaped shaft 42. The screw 46 is tightened until the shaft 42 has a snug, but not tight, fit in the conically shaped bore 38, thereby permitting manual rotation of the signal 22 about its axis 24. In the installed position of the signal 22, the head of the screw 46 and washer 47 are disposed in the recess 41, whereby those fastening component do not interfere with placement of letters and other postal items in the postal box 11.

Referring also to FIG. 7, the lower end of the signal 22 includes a cylindrical shaped wall 51 formed in radially outward spaced coaxial relation to the conically shaped shaft 42. The cylindrical wall 51 has a distal or free end extending horizontally in the same direction as the shaft 49 with its free end facing the flat vertical surface 52 of the depression 28. The free end of the cylindrical wall 51 includes a laterally extending notch 53 which releasably engages a laterally extending detent or protrusion 54 extending laterally outward from the vertical surface 52 of the outer wall 36. The mailbox 11 and signal are made of a plastic having predetermined resiliency. Thus the cylindrical wall 51 will deflect slightly to permit manual camming movement of the signal 22 from its lowered position to its upright position. The cylindrical wall 51 deflects axially a slight amount as a sloping cam surface 56, shown in FIGS. 6 and 7, engages the protrusion 54 on the outer wall 20, thus providing a detented raised position for the signal 22. The notch 53 and the protrusion 54 have complimentary sloping contours facilitating camming movement therebetween when the signal is lowered. Thus the notch 53 and the protrusion 54 are recess and protrusion components of a detent for releasably holding the signal in its raised position.

What is claimed is:

1. A mailbox comprising:

a postal box having laterally spaced upright side wall structures, one of said structures having an inner wall having an inner and outer surface, an outer wall having an inner and outer surface, said outer wall spaced laterally from said inner wall, a laterally extending connector extending between and rigidly interconnecting said inner and outer walls and a laterally extending conically shaped bore extending through said walls and connector, an elongated signal having an upper end and a lower end, said lower end having a conically shaped shaft complimentary to and extending into said conically shaped bore and an axially releasable fastener holding said shaft in said conically shaped bore, said signal being pivotable about the axis of said conically shaped bore between a lowered horizontal position and an upright signal position.

2. The mailbox of claim 1 wherein said inner wall includes a depression in which said conically shaped bore terminates and wherein said fastener is disposed within said depression.

3. The mailbox of claim 2 wherein said releasable fastener is a screw.

4. The mailbox of claim 1 wherein said conically shaped bore diminishes in diameter from said outer wall to said inner wall.

5. The mailbox of claim 1 having a detent formed by a protrusion component and a recess component, one of said components being formed on said outer wall and the other of said components being formed on said signal, said detent releasably holding said signal in its raised position.

6. The mailbox of claim 5 wherein said protrusion component is formed on said outer wall and said recess component is formed in said signal.

7. The mailbox of claim 5 wherein said one component is formed in said outer wall below said conically shaped bore.

8. A mailbox comprising:

a postal box having laterally spaced upright side wall structures, one of said structures having an inner wall having an inner and outer surface, said inner wall having a lateral depression, an outer wall having an inner and outer surface, said outer wall spaced laterally from said inner wall, a laterally extending connector interconnecting said outer wall to said inner wall at said lateral depression, a laterally extending bore extending through said walls and connector terminating at one of its ends in said lateral depression, an elongated signal having an upper end and a lower end, said lower end having a cantilever shaft extending into said bore and a fastener secured to a free end of said shaft and releasably maintaining said shaft in said bore, said fastener being within said lateral depression.

* * * * *